US009042560B2

(12) United States Patent
Ojala

(10) Patent No.: US 9,042,560 B2
(45) Date of Patent: May 26, 2015

(54) SPARSE AUDIO

(75) Inventor: Pasi Ojala, Kirkkonummi (FI)

(73) Assignee: Nokia Corporation, Espoo (FI)

( * ) Notice: Subject to any disclaimer, the term of this patent is extended or adjusted under 35 U.S.C. 154(b) by 358 days.

(21) Appl. No.: 13/517,956

(22) PCT Filed: Dec. 23, 2009

(86) PCT No.: PCT/EP2009/067903
§ 371 (c)(1),
(2), (4) Date: Aug. 7, 2012

(87) PCT Pub. No.: WO2011/076285
PCT Pub. Date: Jun. 30, 2011

(65) Prior Publication Data
US 2012/0314877 A1 Dec. 13, 2012

(51) Int. Cl.
*H04R 5/00* (2006.01)
*G10L 19/02* (2013.01)
*G10L 19/008* (2013.01)

(52) U.S. Cl.
CPC ..... *G10L 19/02* (2013.01); *G10L 19/008* (2013.01)

(58) Field of Classification Search
CPC .... G10L 19/008; G10L 19/24; H04S 2420/03
USPC ..... 381/23; 704/500, 501
See application file for complete search history.

(56) References Cited

U.S. PATENT DOCUMENTS 6,370,502 B1 * 4/2002 Wu et al. ..... 704/230
7,116,787 B2 10/2006 Faller
2006/0238386 A1 * 10/2006 Huang et al. ..... 341/50
2010/0177906 A1 * 7/2010 Vetterli et al. ..... 381/74
2011/0123031 A1 5/2011 Ojala
2011/0178795 A1 * 7/2011 Bayer et al. ..... 704/205

FOREIGN PATENT DOCUMENTS

WO 2011/072729 A1 6/2011

OTHER PUBLICATIONS

Office Action received for corresponding Chinese Application No. 200980163468.X , dated Aug. 9, 2013, 17 pages.

Griffin et al., "Compressed Sensing of Audio Signals Using Multiple Sensors", 16th European Signal Processing Conference, Aug. 25-29, 2008, 5 pages.

Griffin et al., "Encoding the Sinusoidal Model of an Audio Signal Using Compressed Sensing", IEEE International Conference on Multimedia and Expo, Jun. 28-Jul. 3, 2009, pp. 153-156.

(Continued)

*Primary Examiner* — Alexander Jamal
(74) *Attorney, Agent, or Firm* — Alston & Bird LLP

(57) ABSTRACT

A method comprising: sampling received audio at a first rate to produce a first audio signal; transforming the first audio signal into a sparse domain to produce a sparse audio signal; re-sampling of the sparse audio signal to produce a re-sampled sparse audio signal; and providing the re-sampled sparse audio signal, wherein bandwidth required for accurate audio reproduction is removed but bandwidth required for spatial audio encoding is retained AND/OR a method comprising: receiving a first sparse audio signal for a first channel; receiving a second sparse audio signal for a second channel; and processing the first sparse audio signal and the second sparse audio signal to produce one or more inter-channel spatial audio parameters.

20 Claims, 2 Drawing Sheets

(56) References Cited

OTHER PUBLICATIONS

Faller et al., "Binaural Cue Coding—part II: Schemes and Applications", IEEE Transactions on Speech and Audio Processing, vol. 11, Issue 6, Nov. 2003, pp. 520-531.
Candes et al., "An Introduction to Compressive Sampling", IEEE Signal Processing Magazine, vol. 25, Issue 2, Mar. 2008, pp. 21-30.
Mesecher et al., "Exploiting Signal Sparseness for Reduced-Rate Sampling", IEEE Long Island Systems, Applications and Technology Conference, May 1, 2009, pp. 1-6.
Liebchen, "Lossless Audio Coding using Adaptive Multichannel Prediction", Convention Paper, Proceedings of 113th International Audio Engineering Society Convention, Oct. 5-8, 2002, pp. 1-7.
International Search Report and Written Opinion received for corresponding International Patent Application No. PCT/EP2009/067903, dated Sep. 24, 2010, 13 pages.
Breebaart et al., "Parametric Coding of Stereo Audio", EURASIP Journal on Applied Signal Processing, Jan. 1, 2005, pp. 1305-1322.
Short et al., "Multi-Channel Audio Processing Using a Unified Domain Representation", Audio Engineering Society 119th Convention, Convention Paper No. 6526, Oct. 7-10, 2005, pp. 1-7.
Faller, "Parametric Multichannel Audio Coding: Synthesis of Coherence Cues", IEEE Transactions on Audio, Speech, and Language Processing, vol. 14, Issue 1, Jan. 2006, pp. 299-310.
Office Action received for corresponding Chinese Application No. 200980163468.X, dated Apr. 25, 2014, 10 pages.

* cited by examiner

SPARSE AUDIO

RELATED APPLICATION

This application was originally filed as PCT Application No. PCT/EP2009/067903 filed Dec. 23, 2009.

FIELD OF THE INVENTION

Embodiments of the present invention relate to sparse audio. In particular embodiments of the present invention relate to using sparse audio for spatial audio coding and, in particular, the production of spatial audio parameters.

BACKGROUND TO THE INVENTION

Recently developed parametric audio coding methods such as binaural cue coding (BCC) enable multi-channel and surround (spatial) audio coding and representation. The common aim of the parametric methods for coding of spatial audio is to represent the original audio as a downmix signal comprising a reduced number of audio channels, for example as a monophonic or as two channel (stereo) sum signal, along with associated spatial audio parameters describing the relationship between the channels of an original signal in order to enable reconstruction of the signal with a spatial image similar to that of the original signal. This kind of coding scheme allows extremely efficient compression of multi-channel signals with high audio quality.

The spatial audio parameters may, for example, comprise parameters descriptive of inter-channel level difference, inter-channel time difference and inter-channel coherence between one or more channel pairs and/or in one or more frequency bands. Furthermore, further or alternative spatial audio parameters such as direction of arrival can be used in addition to or instead of the inter-channel parameters discussed Typically, spatial audio coding and corresponding downmix to mono or stereo requires reliable level and time difference estimation or an equivalent. The estimation of time difference of input channels is a dominant spatial audio parameter at low frequencies.

Conventional inter-channel analysis mechanisms may require a high computational load, especially when high audio sampling rates (48 kHz or even higher) are employed. Inter-channel time difference estimation mechanisms based on cross-correlation are computationally very costly due to the large amount of signal data.

Furthermore, if the audio is captured using a distributed sensor network and the spatial audio encoding is performed at a central server of the network, then each data channel between sensor and server may require a significant transmission bandwidth.

It is not possible to reduce bandwidth by simply reducing the audio sampling rate without losing information required in the subsequent processing stages.

BRIEF DESCRIPTION OF VARIOUS EMBODIMENTS OF THE INVENTION

A high audio sampling rate is required for creating the downmixed signal enabling high-quality reconstruction and reproduction (Nyquist's Theorem). The audio sampling rate cannot therefore be reduced as this would significantly affect the quality of audio reproduction.

The inventor has realized that although a high audio sampling rate is required for creating the downmixed signal, it is not required for performing spatial audio coding as it is not essential to reconstruct the actual waveform of the input audio to perform spatial audio coding.

The audio content captured by each channel in multi-channel spatial audio coding is by nature very correlated as the input channels are expected to correlate with each other since they are basically observing the same audio sources and the same audio image from different viewpoints only. The amount of data transmitted to the server by every sensor could be limited without losing much of the accuracy or detail in the spatial audio image.

By using a sparse representation of the sampled audio and processing only a subset of the incoming data samples in the sparse domain, the information rate can be reduced in the data channels between the sensors and the server. Therefore, the audio signal needs to be transformed in a domain suitable for sparse representation.

According to various, but not necessarily all, embodiments of the invention there is provided a method comprising: sampling received audio at a first rate to produce a first audio signal; transforming the first audio signal into a sparse domain to produce a sparse audio signal; re-sampling of the sparse audio signal to produce a re-sampled sparse audio signal; and providing the re-sampled sparse audio signal, wherein bandwidth required for accurate audio reproduction is removed but bandwidth required for spatial audio encoding is retained.

According to various, but not necessarily all, embodiments of the invention there is provided an apparatus comprising: means for sampling received audio at a first rate to produce a first audio signal; means for transforming the first audio signal into a sparse domain to produce a sparse audio signal; means for re-sampling of the sparse audio signal to produce a re-sampled sparse audio signal; and means for providing the re-sampled sparse audio signal, wherein transforming into the sparse domain removes bandwidth required for accurate audio reproduction but retains bandwidth required for spatial audio encoding.

According to various, but not necessarily all, embodiments of the invention there is provided an apparatus comprising: at least one a processor; and at least one memory including computer program code, the at least one memory and computer program code configured to, with the at least one processor, cause the apparatus to perform: transforming a first audio signal into a sparse domain to produce a sparse audio signal; sampling of the sparse audio signal to produce a sampled sparse audio signal; wherein transforming into the sparse domain removes bandwidth required for accurate audio reproduction but retains bandwidth required for spatial audio encoding.

According to various, but not necessarily all, embodiments of the invention there is provided a method comprising: receiving a first sparse audio signal for a first channel; receiving a second sparse audio signal for a second channel; and processing the first sparse audio signal and the second sparse audio signal to produce one or more inter-channel spatial audio parameters.

According to various, but not necessarily all, embodiments of the invention there is provided an apparatus comprising: means for receiving a first sparse audio signal for a first channel; means for receiving a second sparse audio signal for a second channel; and means for processing the first sparse audio signal and the second sparse audio signal to produce one or more inter-channel spatial audio parameters.

According to various, but not necessarily all, embodiments of the invention there is provided an apparatus comprising: at least one a processor; and at least one memory including computer program code, the at least one memory and computer program code configured to, with the at least one processor, cause the apparatus to perform: processing a received first sparse audio signal and a received second sparse audio signal to produce one or more inter-channel spatial audio parameters.

According to various, but not necessarily all, embodiments of the invention there is provided a method comprising: sampling received audio at a first rate to produce a first audio signal; transforming the first audio signal into a sparse domain to produce a sparse audio signal; re-sampling of the sparse audio signal to produce a re-sampled sparse audio signal; and providing the re-sampled sparse audio signal, wherein bandwidth required for accurate audio reproduction is removed but bandwidth required for analysis of the received audio is retained.

This reduces the complexity of spatially encoding a multi-channel spatial audio signal.

In certain embodiments, a bandwidth of a data channel between a sensor and server required to provide data for spatial audio coding is reduced.

According to various, but not necessarily all, embodiments of the invention there is provided a method comprising: sampling received audio at a first rate to produce a first audio signal; transforming the first audio signal into a sparse domain to produce a sparse audio signal; re-sampling of the sparse audio signal to produce a re-sampled sparse audio signal; and providing the re-sampled sparse audio signal, wherein bandwidth required for accurate audio reproduction is removed but bandwidth required for analysis of the received audio is retained.

The analysis may, for example, determine a fundamental frequency of the received audio and/or determine inter-channel parameters.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Recently developed parametric audio coding methods such as binaural cue coding (BCC) enable multi-channel and surround (spatial) audio coding and representation. The common aim of the parametric methods for coding of spatial audio is to represent the original audio as a downmix signal comprising a reduced number of audio channels, for example as a monophonic or as two channel (stereo) sum signal, along with associated spatial audio parameters describing the relationship between the channels of an original signal in order to enable reconstruction of the signal with a spatial image similar to that of the original signal. This kind of coding scheme allows extremely efficient compression of multi-channel signals with high audio quality.

The spatial audio parameters may, for example, comprise parameters descriptive of inter-channel level difference, inter-channel time difference and inter-channel coherence between one or more channel pairs and/or in one or more frequency bands. Some of these spatial audio parameters may be alternatively expressed as, for example, direction of arrival.

Figure 1:
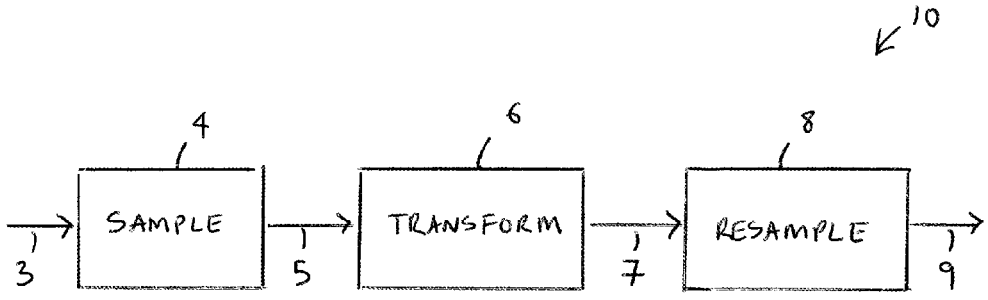
FIG. 1 schematically illustrates a sensor apparatus.

FIG. 1 schematically illustrates a sensor apparatus 10. The sensor apparatus 10 is illustrated functionally as a series of blocks each of which represents a different function.

At sampling block 4, received audio (pressure waves) 3 is sampled at a first rate to produce a first audio signal 5. A transducer such as a microphone transduces the audio 3 into an electrical signal. The electrical signal is then sampled at a first rate (e.g. at 48 kHz) to produce the first audio signal 5. This block may be conventional.

Then at transform block 6, the first audio signal 5 is transformed into a sparse domain to produce a sparse audio signal 7.

Then at re-sampling block 8 the sparse audio signal 7 is re-sampled to produce a re-sampled sparse audio signal 9. The re-sampled sparse audio signal 9 is then provided for further processing.

In this example, transforming into the sparse domain retains level/amplitude information characterizing spatial audio and re-sampling retains sufficient bandwidth in the sparse domain to enable the subsequent production of an inter-channel level difference (ILD) as an encoded spatial audio parameter.

In this example, transforming into the sparse domain retains timing information characterizing spatial audio and re-sampling retains sufficient bandwidth in the sparse domain to enable the subsequent production of an inter-channel time difference (ITD) as an encoded spatial audio parameter.

Transforming into the sparse domain and re-sampling may retain enough information to enable correlation between audio signals from different channels. This may enable the subsequent production of an inter-channel coherence cue (ICC) as a encoded spatial audio parameter.

Figure 2:
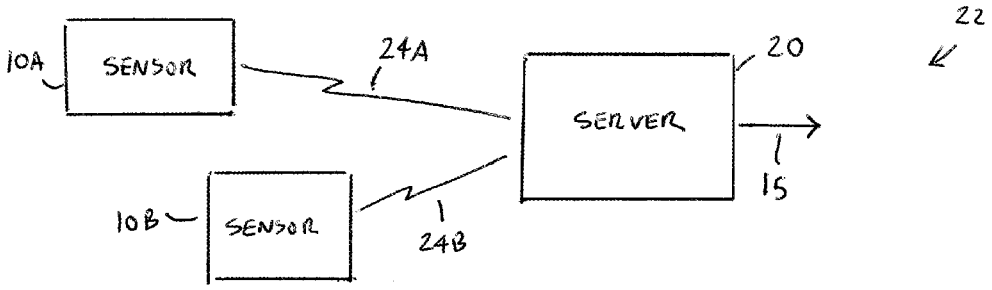
FIG. 2 schematically illustrates a system comprising multiple sensor apparatuses and a server apparatus.

The re-sampled sparse audio signal 9 is then provided for further processing in the sensor apparatus 10 or to a remote server apparatus 20 as illustrated in FIG. 2.

FIG. 2 schematically illustrates a distributed sensor system or network 22 comprising a plurality of sensor apparatus 10 and a central or server apparatus 20. In this example there are two sensor apparatuses 10, which are respectively labelled as a first sensor apparatus 10A and a second sensor apparatus 10B. These sensor apparatus are similar to the sensor apparatus 10 described with reference to FIG. 1.

A first data channel 24A is used to communicate from the first sensor apparatus 10A to the server 22. The first data channel 24A may be wired or wireless. A first re-sampled sparse audio signal 9A may be provided by the first sensor apparatus 10A to the server apparatus 20 for further processing via the first data channel 24A (See FIGS. 3 and 4).

A second data channel 24A is used to communicate from the second sensor apparatus 10B to the server 22. The second data channel 24B may be wired or wireless. A second re-sampled sparse audio signal 9B may be provided by the second sensor apparatus 10B to the server apparatus 20 for further processing via the second data channel 24B (See FIGS. 3 and 4).

Spatial audio processing, e.g. audio analysis or audio coding, is performed at the central server apparatus 20. The central server apparatus 20 receives a first sparse audio signal 9A for a first channel in the first data channel 24A and receives a second sparse audio signal 9B for a second channel in the second data channel 24B. The central server apparatus 20 processes the first sparse audio signal 9A and the second sparse audio signal 9B to produce one or more inter-channel spatial audio parameters 15.

The server apparatus 20 also maintains synchronization between the first sparse audio signal 9A and the second sparse audio signal 9B. This may be achieved, for example, by maintaining synchronization between the central apparatus 20 and the plurality of remote sensor apparatuses 10. Known systems exist for achieving this. As an example, the server apparatus may operate as a Master and the sensor apparatus may operate as Slaves synchronized to the Master's clock such as, for example, is achieved in Bluetooth.

The process performed at a sensor apparatus 10 as illustrated in FIG. 1 removes bandwidth required for accurate audio reproduction but retains bandwidth required for spatial audio analysis and/or encoding.

Transforming into the sparse domain and re-sampling may result in the loss of information such that it is not possible to accurately reproduce the first audio signal 5 (and therefore audio 3) from the sparse audio signal 7.

First Detailed Embodiment

The transform block 6 and the re-sampling block may be considered, as a combination, to perform compressed sampling.

In one embodiment, let f(n) be a vector representing the sparse audio signal 7 that is obtained by transforming the first audio signal 5 (x(n)) with a n×n transform matrix $\Psi$ in transform block 6 where $x(n)=\Psi f(n)$. The transform matrix $\Psi$ could enable a Fourier-related transform such as a discrete Fourier transform (DFT) The sparse audio signal 7 then represents the audio 3 in the transform domain as a vector of transform coefficients f.

The data representation f in the transform domain is sparse such that the first audio signal 5 can be later reconstructed sufficiently well, using only a subset of the data representation f to enable spatial audio coding but not necessarily audio reproduction. The effective bandwidth of signal f in the sparse domain is so low that a small number of samples are sufficient to reconstruct the input signal x(n) at a level of detail required for encoding a spatial audio scene into spatial audio parameters.

At the re-sampling block 8, a subset of the sparse audio signal 7 consisting of m values is acquired with a m×m sensing matrix $\phi$ consisting of row vectors $\phi_k$ as follows $$y_k=\langle f,\phi_k\rangle,\ k=1,\ldots,m \tag{1}$$

If for example the sensing matrix $\phi$ contained only Dirac delta functions, the measured vector y would simply contain sampled values of f. Alternatively, the sensing matrix may pick m random coefficients or simply m first coefficient of the transform domain vector f. There are unlimited possibilities for the sensing matrix. It could also be a complex valued matrix with random coefficients.

In this embodiment, the transform block 6 performs signal processing according to a defined transformation model e.g. transform matrix $\Psi$ and the re-sampling block 8 performs signal processing according to a defined sampling model e.g. sensing matrix $\phi$.

Figure 3:
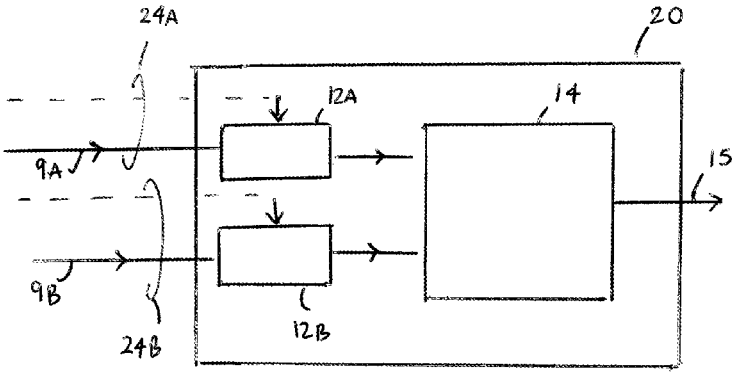
FIG. 3 schematically illustrates one example of a server apparatus.

As illustrated in FIG. 3, the central server apparatus 20 receives a first sparse audio signal 9A for a first channel in the first data channel 24A and receives a second sparse audio signal 9B for a second channel in the second data channel 24B. The central server apparatus processes the first sparse audio signal 9A and the second sparse audio signal 9B to produce one or more inter-channel spatial audio parameters 15.

There are at least two different methods to reconstruct or estimate the first audio signal input signal 5 (x(n)) using the re-sampled audio signal 9 (y) to produce one or more inter-channel spatial audio parameters 15.

First Reconstruction Method

As a defined transformation model and a defined sampling model are used in the sensor apparatus 10, the server apparatus 20 may use this during signal processing.

Referring back to FIG. 2, parameters defining the transformation model may be provided along a data channel 24 to the server apparatus 20 and/or parameters defining the sampling model may be provided along a data channel 24 to the server apparatus 20. The server apparatus 20 is a destination of the re-sampled sparse audio signal 9. Alternatively parameters defining the transformation model and/or the sampling model may be predetermined and stored at the server apparatus 20.

In this example, the server apparatus 20 solves a numerical model to estimate a first audio signal for the first channel and solves a numerical model to estimate a second audio signal for the second channel. It then processes the first audio signal and the second audio signal to produce one or more inter-channel spatial audio parameters.

Referring back to FIG. 3, a first numerical model 12A may model the first audio signal (e.g. x(n)) for a first channel using a transformation model (e.g. transform matrix $\Psi$), a sampling model (e.g. sensing matrix $\phi$) and received first sparse audio signal 9A (e.g. y).

For example, the original audio signal vector x(n) can be reconstructed or estimated in block 12A knowing that $y_k=\phi_k\Psi^{-1}x$. The reconstruction task consisting of n free variables and m equations can be performed applying a numerical optimisation method as follows $$\min_{\tilde{x}\in\mathbb{R}^n}\|\tilde{x}\|_{l_1}\ \text{subject to}\ y_k=\langle\Psi^{-1}\tilde{x},\varphi_k\rangle,\ k=1,\ldots,m. \tag{2}$$

That is, from all the possible valid data vectors $\tilde{x}\in\Re^n$ matching the measured data vector $y=\phi\Psi^{-1}\tilde{x}$ the one that has the lowest $l_1$ norm is selected.

Referring back to FIG. 3, a second numerical model 12B may model the first audio signal (e.g. x(n)) for a second channel using a transformation model (e.g. transform matrix $\Psi$), a sampling model (e.g. sensing matrix $\phi$) and the received second sparse audio signal 9B (e.g. y).

The same or different transformation models (e.g. transform matrices $\Psi$) and sampling models (e.g. sensing matrices $\phi$) may be used for different channels.

For example, the original audio signal vector x(n) can be reconstructed or estimated in block 12B knowing that $y_k=\phi_k\Psi^{-1}x$. The reconstruction task consisting of n free variables and m equations can be performed applying a numerical optimisation method as follows $$\min_{\tilde{x}\in\mathbb{R}^n}\|\tilde{x}\|_{l_1}\ \text{subject to}\ y_k=\langle\Psi^{-1}\tilde{x},\varphi_k\rangle,\ k=1,\ldots,m. \tag{3}$$

That is, from all the possible valid data vectors $\tilde{x}\in\Re^n$ matching the measured data vector $y=\phi\Psi^{-1}\tilde{x}$ the one that has the lowest $l_1$ norm is selected The reconstructed audio signal vector s(n) for the first channel and for the second channel are then processed in block 14 to produce one or more spatial audio parameters.

The inter-channel level difference (ILD) ΔL may be estimated as:

$$\Delta L_m = 10\log_{10}\left(\frac{s^{LT}s^L}{s^{RT}s^R}\right) \tag{4}$$

where $s_m^L$ and $s_m^R$ are time domain left (first) and right (second) channel signals respectively. The inter-channel level difference (ILD) may, in other embodiments, be calculated on a subband basis.

The inter-channel time difference (ITD), i.e. the delay between the two input audio channels may be determined in as follows $$\tau = \arg\max_d\{\Phi(k,d)\} \tag{5}$$

where Φ(d,k) is normalised correlation $$\Phi(d,k) = \frac{s^L(k-d_1)^T s^R(k-d_2)}{\sqrt{(s^L(k-d_1)^T s^L(k-d_1))(s^R(k-d_2)^T s^R(k-d_2))}}$$

The inter-channel time difference (ITD) may, in other embodiments, be calculated on a subband basis.

Second Reconstruction Method

Figure 4:
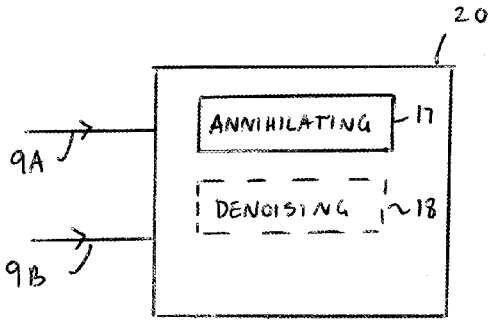
FIG. 4 schematically illustrates another example of a server apparatus.

Referring to FIG. 4, the server apparatus 20 may alternatively use an annihilating filter method when processing the first sparse audio signal 9A and the second sparse audio signal 9B to produce one or more inter-channel spatial audio parameters 15. Iterative denoising may be performed before performing the annihilating filter method.

In one embodiment, the annihilating filter method is performed in block 17 sequentially for each channel pair and the results are combined to produce inter-channel spatial audio parameters for that channel pair.

In this example, the server apparatus 20 uses the first sparse audio signal 9A for the first channel (which may be a subset of transform coefficients for example) to produce a first channel Toeplitz matrix. It then determines a first annihilating matrix for the first channel Toeplitz matrix. It then determines the roots of the first annihilating matrix and uses the roots to estimate parameters for the first channel.

The server apparatus 20 uses the second sparse audio signal for the second channel to produce a second channel Toeplitz matrix. It then determines a second annihilating matrix for the second channel Toeplitz matrix. It then determines the roots of the second annihilating matrix and uses the roots to estimate parameters for the second channel. Finally the server apparatus 20 uses the estimated parameters for the first channel and the estimated parameters for the second channel to determine one or more inter-channel spatial audio parameters.

If iterative denoising is used, then the first channel Toeplitz matrix is iteratively de-noised in block 18 before determining the annihilating matrix for the first channel Toeplitz matrix and the second channel Toeplitz matrix is iteratively denoised before determining the annihilating matrix for the second channel Toeplitz matrix.

In more detail, the data reconstruction is conducted by forming a m×(m+1) Toeplitz matrix using the transform coefficients and their complex conjugates $y_{-m}=y^*_m$ acquired from the received sparse audio signal 9. Hence, 2m+1 coefficients are needed for the reconstruction.

$$H = \begin{bmatrix} y_0 & y_{-1} & \cdots & y_{-m} \\ y_1 & y_0 & \cdots & y_{-m+1} \\ \vdots & \vdots & \vdots & \vdots \\ y_{m-1} & y_{m-2} & \cdots & y_{-1} \end{bmatrix}. \tag{6}$$

In this example, the transform model (e.g. transform matrix Ψ) is a random complex valued matrix or, for example, a DFT transform matrix and the sampling model (e.g. sensing matrix ϕ) selects the firsts m+1 transform coefficients.

The complex domain coefficients of the given DFT or random coefficient transform have the knowledge embedded about the positions and amplitudes of the coefficients of the sparse input data. Hence, as the input data was sparse, it is expected that the Toeplitz matrix contains sufficient information to reconstruct the data for spatial audio coding.

In practice, the complex domain matrix contains the information about the combination of complex exponentials in the transform domain. These exponentials represent the location of nonzero coefficients in the sparse input data f. Basically the exponentials appear as resonant frequencies in the Toeplitz matrix H. The most convenient method to find the given exponentials is to apply Annihilating polynomial that has zeros exactly at those locations cancelling the resonant frequencies of the complex transform. That is, the task is to find a polynomial $$A(z) = \prod_{i=0}^{m-1}(1-u_i z^{-1})$$

such that $$H^*A(z)=0 \tag{7}$$

Now, when the Equation (7) holds, the roots $u_k$ of the polynomial A(z) contain the information about the resonance frequencies of the complex matrix H. The Annihilating filter coefficients can be determined for example using singular valued decomposition (SVD) method and finding the eigenvector that solves the Equation (7). The SVD decomposition is written as H=UΣV*, where U is an m×m unitary matrix, Σ is a m×(m+1) diagonal matrix containing the in nonnegative eigenvalues on the diagonal, and V* is a complex conjugate (m+1)×(m+1) matrix containing the corresponding eigenvectors. As we noted, the matrix H is of the size m×(m+1), and therefore, the rank of the matrix is m (at maximum). Hence, the smallest eigenvalue is zero and the corresponding eigenvector in matrix V* provides the Annihilating filter coefficients solving the Equation (1).

Once the polynomial A(z) is found, the m roots of the form $u_k=e^{j2\pi n_k/N}$ are solved to find the positions $n_k$ of the nonzero coefficients in input data f. The remaining task is to find the corresponding amplitudes $c_k$ for the reconstructed non-zero coefficients. Having the roots of the Annihilating filter and the positions and the first m+1 transform coefficients $y_k$, the in amplitudes can be determined using m equations according to Vandermonde system as follows $$\begin{bmatrix} 1 & 1 & \dots & 1 \\ u_0 & u_1 & \dots & u_{m-1} \\ \vdots & \vdots & \vdots & \vdots \\ u_o^{m-1} & u_1^{m-1} & \dots & u_{m-1}^{m-1} \end{bmatrix}\begin{bmatrix} c_0 \\ c_1 \\ \vdots \\ c_{m-1} \end{bmatrix} = \begin{bmatrix} y_0 \\ y_1 \\ \vdots \\ y_{m-1} \end{bmatrix}. \tag{8}$$

The difference between the reconstruction methods using numerical optimisation method as described above and the above mentioned Annihilating filter method is that the latter is suitable only when the input data has limited number of nonzero coefficients. Using the numerical optimisation with $l_1$ norm, more complex signals may be reconstructed.

The Annihilating filter approach is very sensitive to noise in the vector $y_k$. Therefore, the method may be combined with a denoising algorithm to improve the performance. In this case, the compressed sampling requires more than m+1 coefficients to reconstruct sparse signal consisting of m nonzero coefficients.

Iterative Denoising of the Annihilating Filter

The m×(m+1) matrix H constructed using the received transform coefficients is by definition a Toeplitz matrix. However, the compressed sampled coefficients may have poor signal to noise (SNR) ratio for example due to quantisation of the transform coefficients. In this case the compressed sampling may provide the decoder with p+1 coefficients (p+1>m+1).

The denoising algorithm denoises the Toeplitz matrix using an iterative method of setting the predetermined number of smallest eigenvalues to zero and forcing the resulting matrix output into Toeplitz format.

In more detail, the method first conducts a SVD decomposition of the p×(p+1) matrix as $H=U\Sigma V^*$, set the smallest p−m eigenvalues to zero, build up the new diagonal matrix $\Sigma_{new}$ reconstruct the matrix $H_{new}=U\Sigma_{new}V^*$. The resulting matrix $H_{new}$ may not necessarily be in Toeplitz form any more after the eigenvalue operation. Therefore, it is forced into Toeplitz form by averaging the coefficients on the diagonals above and below the actual diagonal (i.e. the main diagonal) coefficients. The resulting denoised matrix is then SVD decomposed again. This iteration is performed until a predetermined criterion is met. As an example, the iteration may be performed until the eigenvalues smallest p−m eigenvalues are zero or close to zero (e.g. have absolute values below a predetermined threshold). As another example, the iteration may be performed until the $(m+1)^{th}$ eigenvalue is smaller than the $m^{th}$ eigenvalue by a predetermined margin or threshold.

Once the denoising iteration is completed, the Annihilating filter method can be applied to find the positions and amplitudes of the sparse coefficients of the sparse input data f. It should be noted that the m+1 transform coefficients $y_k$ need to be retrieved from the denoised Toeplitz matrix $H_{new}$.

In another embodiment, the annihilating filter method is performed in parallel for each channel pair. In this embodiment an inter-channel annihilating filter is formed.

In this embodiment, the server apparatus 20 uses the first sparse audio signal 9A for the first channel and uses the second sparse audio signal 9B for the second channel to produce an inter-channel Toeplitz matrix. It then determines an inter-channel annihilating matrix for the inter-channel Toeplitz matrix. It then determines the roots of the inter-channel annihilating matrix and uses the roots to directly estimate inter-channel spatial audio parameters (inter-channel delay and inter-channel level difference).

The coefficients of the inter-channel Toeplitz matrix are created by dividing each of the parameters for one of the first sparse audio signal for the first channel or the second sparse audio signal for the second channel by the respective parameter for the other of the first sparse audio signal for the first channel and the second sparse audio signal for the second channel.

Having m+1 or more transform domain coefficients from each input channel the inter channel can be created by first constructing the H matrix as follows $$H = \begin{bmatrix} h_0 & h_{-1} & \dots & h_{-m} \\ h_1 & h_0 & \dots & h_{-m+1} \\ \vdots & \vdots & \vdots & \vdots \\ h_{m-1} & h_{m-2} & \dots & h_{-1} \end{bmatrix}, \tag{9}$$

Where coefficients $h_k=y_{1,k}/y_{2,k}$ represent the inter channel model, and are determined using the input from the first and second channels. In general case the roots of the Annihilating polynomial represents the inter channel model consisting of more than one coefficients. However, using the iterative denoising algorithm described above by setting all but the first eigenvalue to zero, the reconstruction of the inter channel model may be converged to only one nonzero coefficient $u_k$. The coefficient $n_k$ represents the inter channel delay, and the corresponding amplitude $c_k$ represents the inter channel level difference. The Annihilating filter A(z) still has m+1 roots, but there is only one nonzero coefficient $c_k$. Now, the delay coefficient $n_k$ corresponding to the given nonzero amplitude coefficient represents the inter channel delay.

Second Detailed Embodiment for Sensor Apparatus

A sample for first audio signal 5 of an audio channel j at time n may be represented as $x_j(n)$.

Historic past samples for audio channel j at time n may be represented as $x_j(n-k)$, where k>0.

A predicted sample for audio channel j at time n may be represented as $y_j(n)$.

A transform model represents a predicted sample $y_j(n)$ of an audio channel j in terms of a history of an audio channel. A transform model may be an autoregressive (AR) model, a moving average (MA) model or an autoregressive moving average (ARMA) model etc. An intra-channel transform model represents a predicted sample $y_j(n)$ of an audio channel j in terms of a history of the same audio channel j. An inter-channel transform model represents a predicted sample $y_j(n)$ of an audio channel j in terms of a history of different audio channel.

As an example, a first intra-channel transform model $H_1$ of order L may represent a predicted sample $z_1$ as a weighted linear combination of samples of the input signal $x_1$. The signal $x_1$ comprises samples of the first audio signal 5 from a first input audio channel and the predicted sample $z_1$ represents a predicted sample for the first input audio channel.

$$z_1(n) = \sum_{k=0}^{L} H_1(k)x_1(n-k) \tag{10}$$

The summation represents an integration over time. A residual signal is produced by subtracting the predicted signal from the actual signal e.g. $y_1(n)=x_1(n)-z_1(n)$.

As an example, a first inter-channel transform model $H_1$ of order L may represent a predicted sample $z_2$ as a weighted linear combination of samples of the input signal $x_1$. The signal $x_1$ comprises samples of the first audio signal 5 from a first input audio channel and the predicted sample $z_2$ represents a predicted sample for the second input audio channel.

$$z_2(n) = \sum_{k=0}^{L} H_1(k)x_1(n-k) \tag{11}$$

The summation represents an integration over time. A residual signal is produced by subtracting the predicted signal from the actual signal $y_2(n)=x_2(n)-z_2(n)$.

The transform model for each input channel may be determined on a frame by frame basis. The model order may by variable based on the input signal characteristics and available computational power.

The residual signal is a short term spectral residual signal. It may be considered as a sparse pulse train.

Re-sampling comprises signal processing using a Fourier-related transform. The residual signal is transformed using DFT or a complex random transform matrix and m+1 transform coefficients are picked from each channel. The first m+1 coefficients $y_i(n)$ may be further quantised before they are provided to the server apparatus 20 over a data channel 24.

Figure 5:
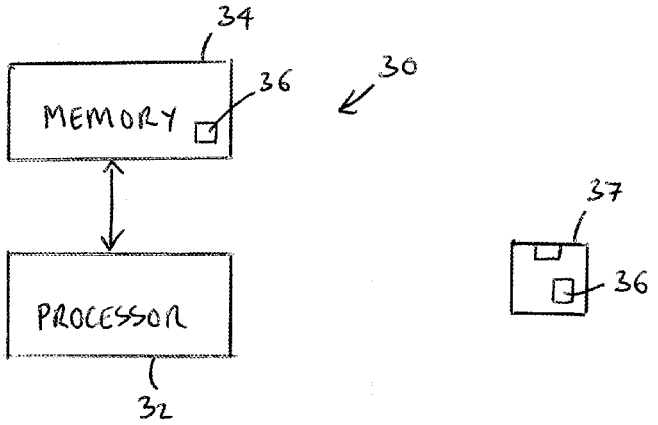
FIG. 5 schematically illustrates an example of a controller suitable for use in either a sensor apparatus and/or a server apparatus.

FIG. 5 schematically illustrates an example of a controller suitable for use in either a sensor apparatus and/or a server apparatus.

The controller 30 may be implemented using instructions that enable hardware functionality, for example, by using executable computer program instructions in a general-purpose or special-purpose processor that may be stored on a computer readable storage medium (disk, memory etc) to be executed by such a processor.

A processor 32 is configured to read from and write to the memory 34. The processor 32 may also comprise an output interface via which data and/or commands are output by the processor 32 and an input interface via which data and/or commands are input to the processor 32.

The memory 34 stores a computer program 36 comprising computer program instructions that control the operation of the apparatus housing the controller 30 when loaded into the processor 32. The computer program instructions 36 provide the logic and routines that enables the apparatus to perform the methods illustrated in any of FIGS. 1 to 4. The processor 32 by reading the memory 34 is able to load and execute the computer program 36.

The computer program may arrive at the controller 30 via any suitable delivery mechanism 37. The delivery mechanism 37 may be, for example, a computer-readable storage medium, a computer program product, a memory device, a record medium, an article of manufacture that tangibly embodies the computer program 36. The delivery mechanism may be a signal configured to reliably transfer the computer program 36. The controller 30 may propagate or transmit the computer program 36 as a computer data signal.

Although the memory 34 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used here 'module' refers to a unit or apparatus that excludes certain parts/components that would be added by an end manufacturer or a user. The sensor apparatus 10 may be a module or an end-product. The server apparatus 20 may be a module or an end-product.

The blocks illustrated in the FIGS. 1 to 4 may represent steps in a method and/or sections of code in the computer program. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method comprising:

sampling received audio at a first rate to produce a first audio signal;

transforming the first audio signal into a sparse domain to produce a sparse audio signal;

re-sampling of the sparse audio signal to produce a re-sampled sparse audio signal; and providing the re-sampled sparse audio signal, wherein the transform into the sparse domain removes bandwidth required for accurate audio reproduction but bandwidth required for spatial audio encoding is retained.

2. A method as claimed in claim 1, wherein transforming into the sparse domain and re-sampling retains level/amplitude information characterizing spatial audio.

3. A method as claimed in claim 1, wherein transforming into the sparse domain and re-sampling retains timing information characterizing spatial audio.

4. A method as claimed in claim 1, wherein transforming into the sparse domain and re-sampling retains enough information to enable correlation between audio signals from different channels.

5. A method as claimed in claim 1, wherein transforming into the sparse domain and re-sampling prevents accurate reproduction of the first audio signal from the sparse audio signal.

6. A method as claimed in claim 1, wherein transforming into the sparse domain comprises signal processing according to a defined model and providing parameters defining the model to a destination of the re-sampled sparse audio signal.

7. A method as claimed in claim 1, wherein transforming into the sparse domain comprises signal processing in which the first audio signal is integrated over time.

8. A method as claimed in claim 1, wherein transforming into the sparse domain comprises signal processing in which a residual signal is produced from the audio signal as the sparse audio signal.

9. A computer program product comprising at least one non-transitory computer readable storage medium having computer-executable program code portions stored therein, the computer-executable program code portions comprising program code instructions configured to cause an apparatus to perform a method according to claim 1.

10. An apparatus comprising:

at least one processor; and at least one memory including computer program code, the at least one memory and computer program code configured to, with the at least one processor, cause the apparatus to perform:

transform a first audio signal into a sparse domain to produce a sparse audio signal;

sample the sparse audio signal to produce a sampled sparse audio signal;

wherein the transform into the sparse domain removes bandwidth required for accurate audio reproduction but retains bandwidth required for spatial audio encoding.

11. An apparatus as claimed in claim 10, wherein the apparatus is configured to perform transform by using a defined model and providing parameters defining the model to a destination of the sampled sparse audio signal.

12. An apparatus as claimed in claim 10, wherein the apparatus is configured to sample by using a defined model and providing parameters defining the model to a destination of the sampled sparse audio signal.

13. An apparatus as claimed in claim 10, wherein the apparatus is configured to sample by selecting a sub-set of available parameters characterizing the sparse audio signal as represented in the sparse domain.

14. A method comprising:

receiving a first sparse audio signal for a first channel;

receiving a second sparse audio signal for a second channel; and processing the first sparse audio signal and the second sparse audio signal to produce one or more inter-channel spatial audio parameters, wherein the first sparse audio signal or second sparse audio signal retained bandwidth required for spatial audio encoding, but the bandwidth required for accurate audio reproduction is removed by a transform of a first or second audio signal into a sparse domain.

15. A method as claimed in claim 14, further comprising maintaining synchronization between the first sparse audio signal and the second sparse audio signal.

16. A method as claimed in claim 14, further comprising:

solving a numerical model to estimate a first audio signal for the first channel;

solving a numerical model to estimate a second audio signal for the second channel; and processing the first audio signal and the second audio signal to produce one or more inter-channel spatial audio parameters.

17. A method as claimed in claim 14, wherein processing the first sparse audio signal and the second sparse audio signal to produce one or more inter-channel spatial audio parameters uses an annihilating filter method.

18. A method as claimed in claim 17, further comprising performing iterative denoising before performing the annihilating filter method.

19. A computer program product comprising at least one non-transitory computer readable storage medium having computer-executable program code portions stored therein, the computer-executable program code portions comprising program code instructions configured to cause an apparatus to perform a method according to claim 14.

20. An apparatus comprising:

at least one a processor; and at least one memory including computer program code, the at least one memory and computer program code configured to, with the at least one processor, cause the apparatus to perform:

process a received first sparse audio signal and a received second sparse audio signal to produce one or more inter-channel spatial audio parameters, wherein the first sparse audio signal or second sparse audio signal retain bandwidth required for spatial audio encoding, but the bandwidth required for accurate audio reproduction is removed by a transform of a first or second audio signal into a sparse domain.

* * * * *